US011788804B2

(12) United States Patent
Bry et al.

(10) Patent No.: US 11,788,804 B2
(45) Date of Patent: Oct. 17, 2023

(54) HEADER TANK AND CORRESPONDING HEAT EXCHANGER

(71) Applicant: Valeo Systemes Thermiques, Le Mesnil-Saint-Denis (FR)

(72) Inventors: Samuel Bry, Laval (FR); Patrick Boisselle, Laval (FR); Jérôme Blanchard, Laval (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 0 days.

(21) Appl. No.: 17/059,829

(22) PCT Filed: May 28, 2019

(86) PCT No.: PCT/FR2019/051247

§ 371 (c)(1),
(2) Date: Nov. 30, 2020

(87) PCT Pub. No.: WO2019/229369

PCT Pub. Date: Dec. 5, 2019

(65) Prior Publication Data

US 2021/0215442 A1 Jul. 15, 2021

(30) Foreign Application Priority Data

May 31, 2018 (FR) ..... 1854742

(51) Int. Cl.
*F28F 9/16* (2006.01)
*F28D 1/053* (2006.01)
*F28F 9/02* (2006.01)

(52) U.S. Cl.
CPC ..... *F28F 9/16* (2013.01); *F28D 1/05366* (2013.01); *F28F 9/0248* (2013.01);
(Continued)

(58) Field of Classification Search
CPC ..... F28F 9/165; F28F 9/167; F28F 2265/32; F28F 2275/125; F28F 9/16; F28F 9/0248; F28F 2275/00; F28D 1/05366
See application file for complete search history.

(56) References Cited

U.S. PATENT DOCUMENTS 5,311,934 A * 5/1994 Potier ..... F28F 9/165 165/173
5,535,821 A * 7/1996 Potier ..... F28F 9/165 165/173
8,689,858 B2 * 4/2014 Rothenhofer ..... F28D 9/0062 165/166

FOREIGN PATENT DOCUMENTS

CN 1095022 A 11/1994
CN 1914473 A 2/2007
(Continued)

OTHER PUBLICATIONS

International Search Report and Written Opinion in corresponding International Application No. PCT/FR2019/051247, dated Jul. 31, 2019 (10 pages).
(Continued)

*Primary Examiner* — Tho V Duong
*Assistant Examiner* — Raheena R Malik
(74) *Attorney, Agent, or Firm* — Osha Bergman Watanabe & Burton LLP

(57) ABSTRACT

The invention relates to a header tank (5) for a mechanically assembled heat exchanger, notably for a motor vehicle, said exchanger (1) comprising a mechanically assembled heat-exchange core bundle (3) and comprising at least one row of tubes (31) with two end tubes (31) one at each end of said at least one row, the tubes (31) respectively comprising an end (311) intended to open into an interior volume of the header tank (5). According to the invention, the header tank (5) comprises at least one end stop (55) configured to be
(Continued)

Figure 1:
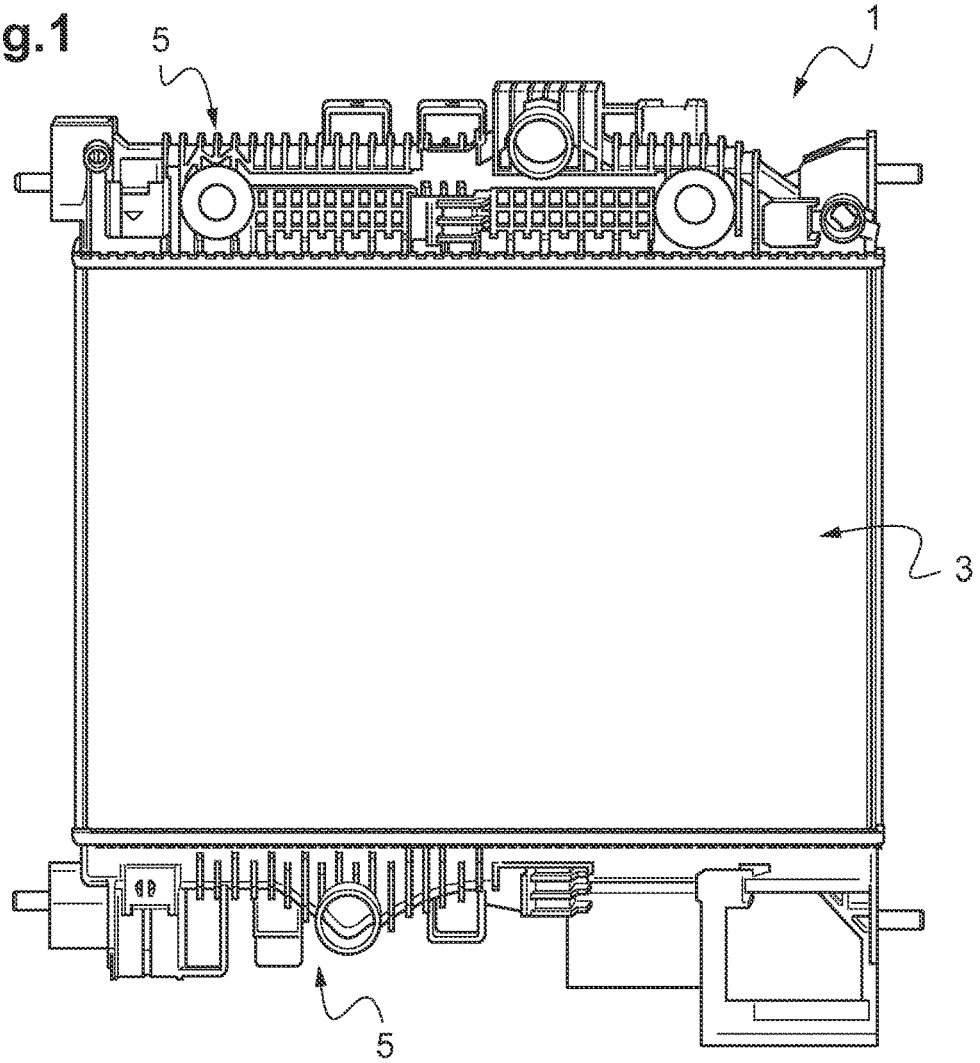

positioned facing an internal surface of the end (311) of an associated end tube (31) and to collaborate with said internal surface in such a way as to prevent said tube (31) from moving in the direction of the interior volume of the header tank (5).

12 Claims, 2 Drawing Sheets

(52) U.S. Cl.
CPC ..... *F28F 2265/32* (2013.01); *F28F 2275/00* (2013.01); *F28F 2275/125* (2013.01)

(56) References Cited

FOREIGN PATENT DOCUMENTS

| | | | |
|---|---|---|---|
| EP | 0567397 | A1 | 10/1993 |
| EP | 0624772 | A1 | 11/1994 |
| FR | 2690229 | A1 | 10/1993 |
| FR | 3056734 | A1 | 3/2018 |

OTHER PUBLICATIONS

The First Office Action in corresponding Chinese Application No. 201980046693.9, dated Dec. 23, 2021 (12 pages).

* cited by examiner

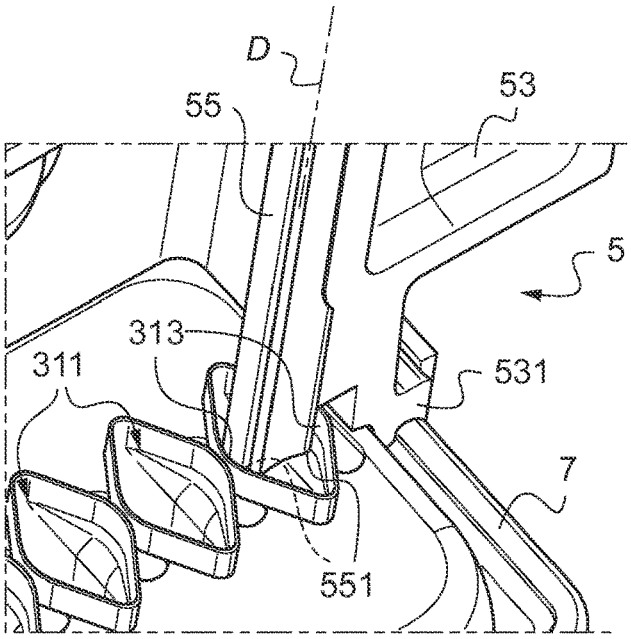
Fig.3a
Fig.3b
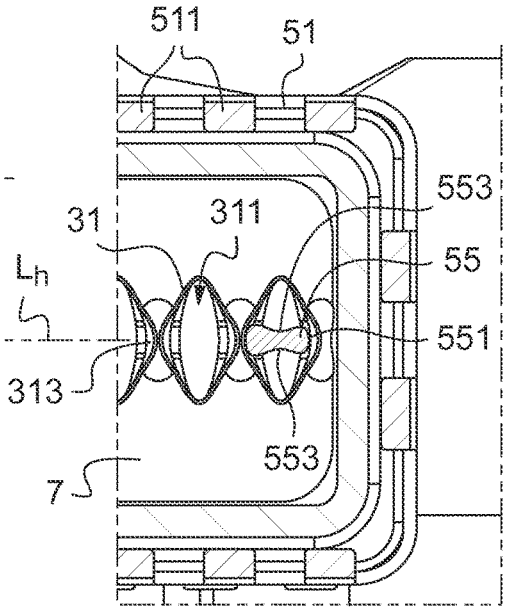
Fig.3c
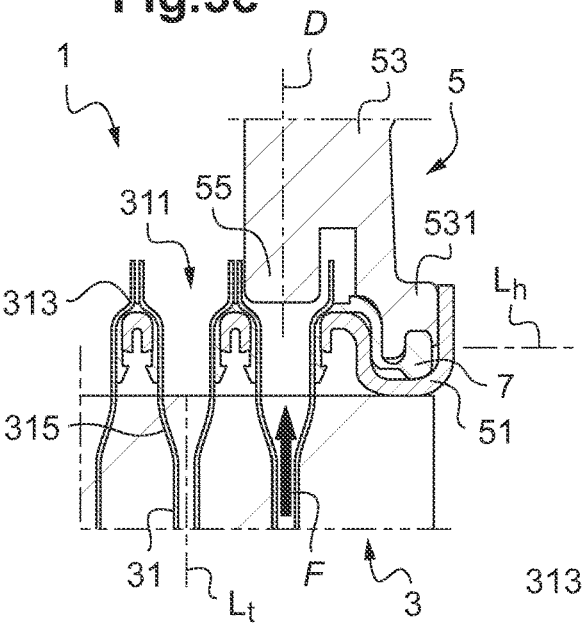
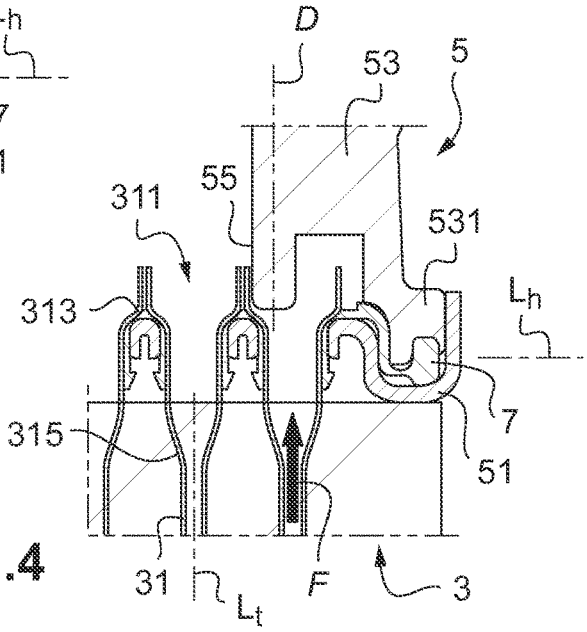
Fig.4

HEADER TANK AND CORRESPONDING HEAT EXCHANGER

The invention relates to the field of heat exchangers, particularly for motor vehicles. The invention relates in particular to a header tank for such a heat exchanger.

The invention relates more specifically to a heat exchanger referred to as a mechanical heat exchanger, particularly a radiator, notably a cooling radiator. In that case, the elements of the heat exchanger are assembled mechanically, namely at ambient temperature, for example using crimping, swaging, clip-fastening or other forms of mechanical connection, and without brazing, which is to say without the addition of material.

Heat exchangers conventionally comprise a heat-exchange core bundle and at least one, generally two, header tanks or housings for distributing a heat-transfer fluid.

The heat-exchange core bundle comprises a plurality of tubes, such as flat tubes, arranged in one or more rows through which the heat-transfer fluid is intended to flow. Each row of tubes comprises two end tubes, one at each end of the row. Heat-exchange elements, such as fins, may also be provided between the tubes in order to improve the exchange of heat. The fins are generally placed parallel to one another and perpendicular to the tubes. The fins are therefore provided with holes through which the tubes can pass. The heat-exchange core bundle is held together mechanically. To do this, a tool, for example a swaging tool, is introduced into the tubes so as to deform the walls of the tubes and forcibly apply them against the holes made in the fins.

In the known way, each header tank comprises a header plate that accepts the ends of the tubes. A cover fits over the header plate to close the header tank.

In an exchanger of mechanical type, it is also known practice to fit a sealing gasket on the header plate, and the ends of the tubes likewise pass through this gasket. The tubes and each header plate are assembled mechanically using a swaging operation, known as flaring, which consists in flaring the respective ends of the tubes in order to compress the sealing gasket.

However, such a mechanical heat exchanger is unable to exhibit mechanical strength characteristics, notably characteristics sufficient for withstanding pressure cycles. Specifically, under the action of the pressure exerted by the heat-transfer fluid, the tubes become inflated, causing the fins to deform, particularly at their ends which may bend. As the tubes deflate, the deformed ends of the fins may catch on at least an end tube and cause it to move, notably to move up toward the interior volume of the header tank. The flared end of the end tube therefore moves further away from the sealing gasket, and sealing is no longer assured.

It is therefore important to prevent such movement of an end tube toward the inside of the header tank, in order to ensure sealing.

In order to overcome these disadvantages, it has been envisioned to provide an end stop configured to butt against the edge face of an end tube in the event of the latter moving toward the interior volume of a header tank.

However, the flat tubes are small in thickness, typically being under one millimeter thick, for example having a thickness of the order of 0.3 mm to 0.2 mm. In particular, the very thin flat tubes, notably having a thickness of the order of 0.20 mm to 0.25 mm, are unable to withstand the force applied by such abutment. In order to halt the movement of an end tube, such an end stop comes to bear against a small surface area on the edge face of the end tube, and digs into the end tube, deforming it. Sealing is therefore no longer assured.

In addition, this solution needs to take account of the tolerances on the lengths of the tubes, which are for example of the order of 3 mm, which means that the end stop has to allow movement by at least this amount in order for the header tanks to be able to be assembled with the heat-exchange core bundle without the longer tubes becoming damaged.

It is therefore an objective of the invention to at least partially alleviate these problems of the prior art by proposing a heat exchanger able to respond to the pressure constraints while at the same time reducing the risks of leaks.

To this end, one subject of the invention is a header tank for a mechanically assembled heat exchanger, notably for a motor vehicle, said exchanger comprising a mechanically assembled heat-exchange core bundle and comprising at least one row of tubes with two end tubes one at each end of said at least one row, the tubes respectively comprising an end intended to open into an interior volume of the header tank.

According to the invention, the header tank comprises at least one end stop configured to be positioned facing an internal surface of the end of one of the associated end tubes. Said at least one end stop is configured to collaborate with said internal surface in such a way as to prevent said tube from moving in the direction of the interior volume of the header tank.

Such an end stop makes it possible to halt or limit the movement of an end tube by providing retention inside the end of the end tube. Typically, such an end stop is able to limit the movement of the end tube by preventing it from moving by more than a predetermined clearance (for example of under 1 millimeter) toward the interior volume of the header tank. The pulling-up of the associated end tube toward the interior volume of the header tank is therefore reduced if not to say blocked, thus holding the flared end of the end tube in place, in contact with the sealing gasket. Thus, the sealing of the header tank is improved at the junction between it and the associated end tube.

The header tank may also comprise one or more of the following features, considered separately or in combination:

- the header tank comprises at least two end stops, each configured to be positioned facing an internal surface of the end of one of the two end tubes;
- said at least one end stop is configured to be positioned facing the internal surface of the end of the associated end tube with a clearance less than or equal to one millimeter;
- said at least one end stop is configured to be arranged at least partially inside the end of the associated end tube;
- said at least one end stop is configured with a peripheral contour able to be housed in its entirety inside the end of the associated end tube;
- the header tank is configured to accept ends of tubes having at least one flare and said at least one end stop has an overall shape that complements the shape of said at least one flare of the end of the end tube;
- the header tank is configured to accept ends of flat tubes having two opposite long edges, and said at least one end stop is configured to collaborate with at least one long edge of the end of the associated end tube;
- said at least one end stop is configured to collaborate with a single long edge;
- said at least one end stop is configured to collaborate with both long edges;

the header tank is configured to accept ends of flared tubes of polygonal shape, of which at least two sides are connected by a rounded vertex;

said at least one end stop has at least one curved portion of a shape complementing the rounded vertex of the end of the associated end tube;

said at least one end stop has an oblong overall shape with two curved longitudinal end portions configured to collaborate with two opposing rounded vertices of the end of the associated end tube;

said at least one end stop has a tapered central portion;

said at least one end stop has two convex opposite edges with their convexity oriented toward the inside of the end stop;

the header tank comprises: a header plate intended to have the ends of the tubes of the heat-exchange core bundle passing through it, and a cover assembled with the header plate in such a way as to close the header tank;

said at least one end stop is formed as one piece with the cover, extending in the direction of the header plate;

said at least one end stop is molded with the cover;

the cover extends longitudinally in a main direction of extension;

said at least one end stop extends transversely with respect to the main direction of extension of the cover;

the header tank comprises at least one compressible sealing gasket arranged at least partially on the header plate and around the ends of the tubes opening into the header tank, and wherein the flares of the tubes are configured to compress the sealing gasket.

The invention also relates to a mechanically assembled heat exchanger, notably for a motor vehicle, comprising a mechanically assembled heat-exchange core bundle, said core bundle comprising at least one row of tubes with two end tubes one at each end of said at least one row, and at least one header tank as defined hereinabove, into which ends of the tubes open.

The heat exchanger may also comprise one or more of the following features, considered separately or in combination:

said at least one end stop is arranged at least partially inside the end of the associated end tube;

said at least one heater tank comprises a header plate;

the tubes respectively have an external flare on the side of the header plate opening onto the interior volume of the header tank and an internal flare on the opposite side;

said at least one end stop is configured to collaborate with the external flare of the associated end tube;

the heat-exchange core bundle comprises a predetermined number of fins through which the tubes pass;

the heat exchanger comprises two header tanks according to the invention, one on each side of the heat-exchange core bundle.

Figure 2:
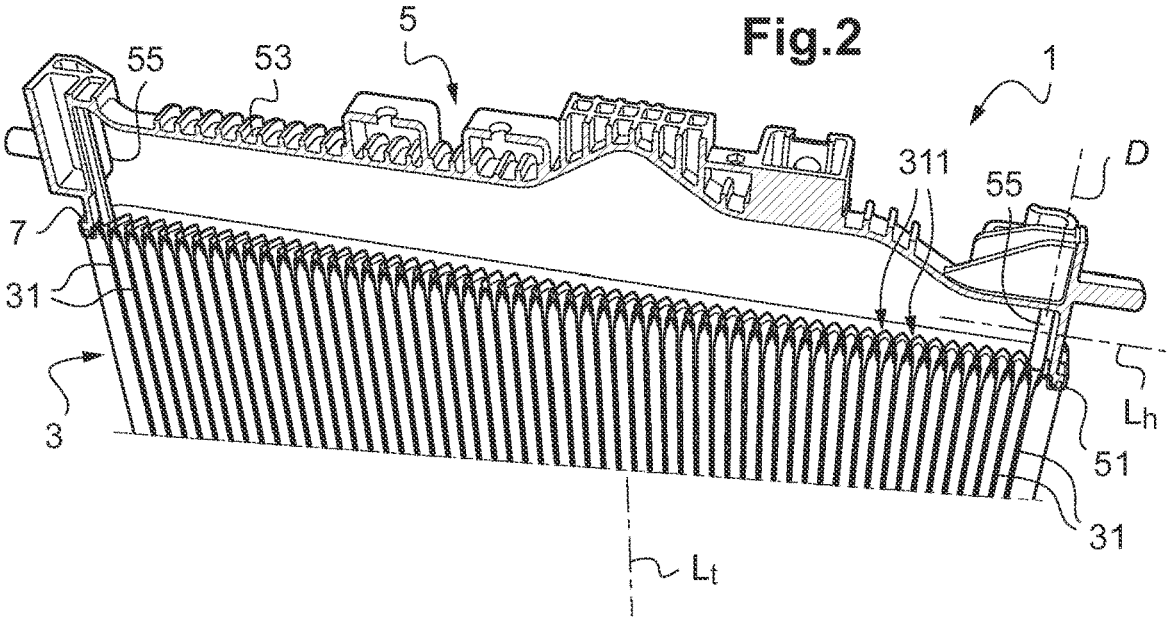

Further features and advantages of the invention will become more clearly apparent from reading the following description, which is given by way of nonlimiting illustrative example, and from the appended drawings, in which:

FIG. 1 is an overall view of a mechanical heat exchanger,

FIG. 2 is a view in section showing, in perspective, part of the heat exchanger of FIG. 1 comprising a header tank according to a first variant, FIG. 3*a* is a view in partial section and in perspective of a header tank of the heat exchanger of FIG. 2, into which tank ends of tubes open, FIG. 3*b* is a partial view in transverse section at the level of the header tank of the heat exchanger of FIG. 2, FIG. 3*c* is a partial view in longitudinal section of the heat exchanger of FIG. 2, and FIG. 4 is a partial view in longitudinal section of the heat exchanger comprising a header tank according to a second embodiment variant.

In these figures, identical elements have been referenced with the same references.

The following embodiments are examples. Although the description refers to one or more embodiments, this does not necessarily mean that each reference relates to the same embodiment, or that the features apply only to a single embodiment. Individual features of various embodiments may also be combined or interchanged in order to create other embodiments.

In the description, certain elements may be indexed, such as for example as first element or second element. In this case, the index is simply used to differentiate and denote elements that are similar but not identical. This indexing does not imply a priority of one element with respect to another and such denominations may easily be interchanged without departing from the scope of the present description. This indexing also does not imply an order in time.

Reference is made to FIG. 1 which depicts a heat exchanger 1, notably intended to be fitted to a motor vehicle, such as a radiator.

The heat exchanger 1 is of mechanical type. What is meant by a mechanical heat exchanger 1 is that the various elements that make up the heat exchanger 1 are joined together mechanically, for example by crimping.

With reference to FIG. 2, a heat exchanger 1 conventionally comprises:

a heat-exchange core bundle 3 comprising a plurality of tubes 31, and at least one header tank 5, generally two header tanks 5.

Each header tank 5 may be made in two parts: a header plate 51 through which the tubes 31 are intended to pass, and a cover 53, intended to be fixed to the header plate 51 to at least partially close the header tank 5. The invention relates more particularly to such a header tank 5, described in greater detail hereinafter.

As far as the heat-exchange core bundle 3 is concerned, it is mechanically assembled, which means to say that it comprises heat-exchange elements assembled with one another mechanically, for example using swaging or crimping, without any brazing step.

A first heat-transfer fluid, such as a liquid, is intended to circulate in the tubes 31. A second fluid, such as a flow of air, is intended to circulate around the tubes 31.

The tubes 31 partially depicted in FIG. 2 are arranged in one or more rows. Each row comprises two end tubes 31, one at each end of the row. The tubes 31 are for example arranged parallel.

The tubes 31 may extend along a longitudinal axis $L_t$. These may notably be tubes 31 referred to as "flat", having a thickness that is small, less than one millimeter, for example of the order of 0.33 mm to 0.20 mm, preferably of the order of 0.22 mm.

The heat-exchange core bundle 3 may also comprise fins (not depicted). The tubes 31 may be arranged so that they pass respectively through a plurality of superposed fins (not depicted) such as these.

Furthermore, the heat-exchange core bundle 3 is intended to be assembled mechanically to the or each header tank 5. In order to do this, the tubes 31 are mechanically assembled with the header plate 51 of each header tank 5, with the interposition of a sealing gasket 7. The sealing gasket 7 has openings designed to accept the ends of the tubes 31. More specifically, this is a compressible sealing gasket 7 arranged at least partially on the header plate 51 and around the ends of the tubes 31 opening into the header tank 5 upon assembly of the heat exchanger 1.

The tubes 31 can be mounted between the two header tanks 5 in such a way that the ends of the tubes 31 pass through the respective header plates 51.

The ends of the tubes 31 opening into each header tank 5 are then intended to undergo plastic deformation, for example by swaging or flaring the ends of the tubes 31. The deformation or flaring can be done in a direction that is radial with respect to the longitudinal axis $L_t$ of the tubes 31. The flaring of the ends 311 of the tubes 31 is achieved for example by punching these ends. The ends 311 of the tubes 31 are flared in such a way as to compress the sealing gasket 7 between the ends 311 of the tubes 31 and the header plate 51.

In the case of flat tubes 31, the ends of the tubes 31, prior to flaring, have a transverse section of, for example, oblong overall shape, with two long opposite longitudinal edges connected by short edges which, for example, are rounded edges.

The flaring can be performed in a localized manner, which means to say that the flaring is not performed over the entire periphery of the end of a tube 31. Provision may be made for the ends of the tubes 31 to be flared at least locally in such a way as to define one or more flares 313 (FIGS. 3*a* to 4) on the periphery of the ends of the tubes 31, namely on the side opening into the interior volume of the header tank 5 in the assembled state.

The flares 313 are performed on the header plate 51 that bears the sealing gasket 7, namely the opposite side to the side facing toward the fins (not depicted). The flares 313 on the peripheries of the ends of the tubes 31 therefore form bearing zones resting against the sealing gasket 7. The flares 313 allow the sealing gasket 7 to be compressed and held in place to ensure sealing between the header plate 51 and the tubes 31. They perform a function of mechanically retaining the sealing gasket 7.

In the case of flat tubes 31, the flaring is performed using a punch which enlarges the end of the tube 31 in the width direction. The width of the ends of the tubes 31 means the dimension connecting the two opposite long edges. At the level of the flare or flares 313, the width of the ends of the tubes 31 increases.

The flaring is for example performed substantially in the middle of the longitudinal edges of the end of each tube 31.

Each end of tube 31 after flaring has a polygonal shape, in the example illustrated, the overall shape of a lozenge.

The punch used for flaring may have a spherical shape. In that case, the polygonal shape of the end after flaring, for example a lozenge shape, may have at least one rounded vertex connecting two sides. In an embodiment variant illustrated in FIGS. 3*a* and 3*b*, the ends of tubes 31 after flaring have the overall shape of a lozenge defined by four sides connected in pairs by rounded vertices. The rounded vertices in the direction of the width of the end of a tube 31 correspond to the flares 313.

According to one embodiment, provision may be made for the ends of the tubes 31 to be flared in at least two distinct transverse sections of the ends of the tubes 31, as can be seen in FIG. 3*c* or 4. In particular, the ends of the tubes 31 may exhibit:

- the flare or flares 313 termed external on the periphery of the ends of the tubes 31 opening into the header tank 5, namely on the exterior side of the heat-exchange core bundle 3, and
- also one or more other flares 315, termed internal, produced on the side of the rest of the heat-exchange core bundle 3, namely on the interior side of the heat-exchange core bundle 3.

The width of the ends of the tubes 31 at the level of the external flares 313 is greater than the width of the ends of the tubes 31 at the level of the internal flares 315.

With reference once again to FIG. 2, the header tank or tanks 5 allow the first fluid to be distributed toward the tubes 31 or allow the first fluid that has passed through these tubes 31 to be collected.

The cover 53 extends longitudinally in a main direction of extension $L_h$ which is transverse or substantially transverse to the longitudinal axis $L_t$ of the tubes 31 when the heat exchanger 1 is in the assembled state.

Each header plate 51 is arranged transversely with respect to the tubes 31, extending in the direction $L_h$.

Each header plate 51 is respectively intended to have ends of tubes 31 pass through it when the heat exchanger 1 is in the assembled state. For this purpose, each header plate 51 may comprise a plurality of passage openings for the ends of the tubes 31 of the heat-exchange core bundle 3. The shape of these openings complements the shape of the ends of the tubes 31 prior to flaring.

In addition, each header plate 51 is mechanically assembled with the associated cover 53. The header plate 51 comprises, for example, crimping lugs 511 (see FIG. 3*b*) that can be folded over onto the cover 53. In particular, the crimping lugs 511 are folded over onto a peripheral rim of the cover 53, or cover footing 531 (visible in FIGS. 3*c* and 4) which becomes fixed to the header plate 51, compressing the sealing gasket 7 fitted on the header plate 51, more specifically against a peripheral part of the sealing gasket 7. The sealing gasket 7 therefore ensures sealing between the cover 53 and the header plate 51 in addition to the sealing between the ends of the tubes 31 and the header plate 51.

The header tank 5 further comprises at least one end stop 55. This is a fixed end stop 55.

The end stop 55 is advantageously provided at a strategic point, for example at a longitudinal end of the header tank 5. Two end stops 55 are provided for example at the longitudinal ends of the header tank 5. The end stops 55 are intended to be placed facing, or even to be at least partially inserted inside, the ends of the end tubes 31 at the beginning and/or at the end of a row of the heat-exchange core bundle 3.

More specifically, the end stops 55 intended to be positioned facing an internal surface of the end of an associated end tube 31. Each end stop 55 may be positioned as close as possible to the internal surface of the end of the associated end tube 31, with a clearance less than or equal to one millimeter.

The end stop 55 is intended to collaborate with the internal surface of the end of the end tube 31, so as to immobilize the end tube 31, to prevent any potential movement of the tube 31 toward the interior volume of the header tank 5, as indicated schematically by the arrow F in FIGS. 3*c* and 4. Such a movement toward the interior volume of the header tank 5 may be brought about when a force is applied to the end tube 31, for example by the fins (not depicted). More specifically, the end stop 55 bears or comes to bear against this internal surface. By preventing the end tube 31 from moving up inside the header tank 5, the end stop 55 thus prevents the end tube 31 from possibly coming out of the sealing gasket 7.

In order to achieve this, the end stops 55 are advantageously borne by, and more specifically formed on, the cover 53, for example being formed integrally therewith. The end stops 55 may be molded with the cover 53, so as to form a single one-piece component without the need to attach an additional part. That avoids there being an assembly clearance between the end stop 55 and the cover 53 and makes it possible to have a precise dimension.

The end stops 55 formed on the cover 53 extend toward the header plate 51, and therefore toward the ends of the tubes 31 when the heat exchanger 1 is in the assembled state. In particular, each end stop 55 extends in a direction D that is transverse with respect to the main direction of extension $L_h$ of the cover 53. The end stops 55 therefore extend parallel to the longitudinal axis $L_t$ of the tubes 31.

Furthermore, each end stop 55 is shaped with a peripheral contour able to be housed entirely inside the end of the associated end tube 31, as is best visible in FIG. 3*a* or 3*b*. In that way, the end stop 55 does not deform the edge face for example of the end tube 31 but blocks the movement of the end tube 31 from the inside.

Thus, on assembly of the heat exchanger 1, each end stop 55 can be arranged in such a way that its free end is housed inside the end of the associated end tube 31, bearing against the internal surface of the end of the end tube 31 so as to oppose any movement of the end tube 31. In a variant, each end stop 55 may be arranged facing the associated end tube 31 with a clearance, for example of less than one millimeter, and if the end tube 31 moves, the end stop 55 then enters the end of the end tube 31 more deeply to come to bear against the internal surface and limit the movement.

Furthermore, as explained hereinabove, the tubes 31 of the core bundle 3 may be flat tubes 31, having, in transverse section, two opposite long longitudinal edges. Each end stop 55 may be intended to collaborate with one long edge or both long edges of the end of the associated end tube 31. As illustrated in FIGS. 3*a* to 3*c*, each end stop 55 may be configured to collaborate with the two long edges of the end of the associated end tube 31. In a variant, as illustrated in FIG. 4, each end stop 55 may be configured to collaborate with a single long edge; the opposite side may be free. With reference to the layout of the elements in FIG. 4, the end stops 55 may be designed to approach the ends of the end tubes 31 non-straightforwardly. In the latter instance, the end stop is therefore not at the center of the end 311 of the tube 31 but is arranged asymmetrically.

Each end stop 55 also adopts an overall shape that complements the shape of the end of the associated end tube 31 after flaring, particularly at the region of the external flare 313. In order to do this, each end stop 55 may have the same shape as the flaring punch. Thus, in order to immobilize the tube 31, it is the end 311 of the tube 31, rather than the edge face of the tube 31, that is in abutment or comes into abutment, for example in the event of tube movement, with a shape similar to the flaring punch which therefore does not deform the tube 31. The retention is robust even in the case of a tube 31 of small thickness, for example of the order of 0.22 mm thick.

For example, for end tubes 31 of which the ends after flaring have a polygonal overall shape of which at least two sides are connected by a rounded vertex formed by the flare 313, the end stops 55 may have at least one curved portion 551 (best visible in FIGS. 3*a*, 3*b*) of a shape that complements this rounded vertex.

In particular, each end stop 55 may have an oblong overall shape with two curved longitudinal-end portions 551. These curved portions 551 are configured to collaborate with two opposing rounded vertices of the end of the associated end tube 31, which vertices are formed by the flares 313 in the direction of the width of the tube 31.

Thus, on assembly of the heat exchanger 1, when the end stops 55 are arranged with their free ends housed inside the end of the associated end tube 31, the curved portions 551 bearing against the internal surface of the end of the end tube 31 at the level of the flares 313. In a variant, when the end stops 55 are arranged facing the end tubes 31 with clearance, if a force is applied to an end tube 31 that causes it to move toward the interior volume of the header tank 5, the end stop 55 therefore penetrates the end of the end tube 31 more deeply so that the curved portions 551 come to bear against the internal surface of the end of the end tube 31 at the level of the flares 313. The end stop 55 is therefore implanted or intended to be implanted in the retaining flare 313 that retains the tube 31. This offers a maximum of bearing surface area for each end stop 55 to bear against the internal surface of the end of the associated end tube 31.

Furthermore, each end stop 55 may have a tapered central portion. This is particularly advantageous in the case of an end stop 55 configured to collaborate with the two long edges of the end of an associated end tube 31.

According to an embodiment illustrated in FIG. 3*b*, each end stop 55 may have two convex opposite edges 553 with their convexity oriented toward the inside of the end stop 55.

This then reduces the cross section of the end stop 55 so as not to disrupt the flow of the first heat-transfer fluid. Specifically, by reducing the thickness at the center, the end tube 31 is not plugged and allows the heat-transfer fluid to pass. The tapered or thinner shape in the middle of the end stop 55 makes it possible to limit the impact on the pressure drop.

The cross section of the end stop 55 is smaller than the cross section of the tube 31 inside the core bundle 3 (FIGS. 3*c*, 4) so that the cross section for the passage of the heat-transfer fluid in the region of the end stop 55 is equivalent to or greater than the cross section for the passage of the heat-transfer fluid of the tube 31 inside the core bundle 3.

In the case of an end tube 31 having one or more external flare(s) 313 and one or more internal flare(s) 315 with at least two distinct transverse sections of the end 311 of the tube 31, the cross section of the end tube 31 at the level of the internal flare 315 is smaller than the cross section of the end tube 31 at the level of the external flare 313 minus the surface area of the end stop 55.

Thus, each end stop 55, advantageously borne by the cover 53, positioned facing with a small clearance, or bearing against, a surface inside the flared part of the end 311 of the associated end tube 31, is able to oppose the movement or limit the movement of this end tube 31, for example under the action of the fins (not depicted). This then avoids the end tubes 31 moving away from the sealing gasket 7, thus ensuring the mechanical integrity of the tubes 31 and the sealing between the header plate 51 and the tubes 31.

In addition, by sitting inside the end tubes 31, particularly in the shape left by the flaring punch, use is made of the side of the flare which is more precise than the edge face of the tube 31 for example, without potentially damaging the ends 311 of the tubes 31 by using a large bearing surface of the end stop 55.

Finally, such end stops 55 which are designed only to enter the end tubes 31, have no impact on the internal pressure drop of the heat-exchange core bundle 3, unlike end stops 55 intended to enter the ends of all the tubes 31.

The invention claimed is:

1. A header tank for a mechanically assembled heat exchanger for a motor vehicle, the header tank comprising:
at least one end stop configured to:
be positioned facing an internal surface of an end of one of a plurality of associated end tubes,
collaborate with the internal surface to prevent the one of the plurality of the associated end tubes from moving in a direction of an interior volume of the header tank,
wherein the header tank is configured to accept ends of the plurality of associated end tubes having two opposite long edges, and wherein the at least one end stop collaborates with at least one long edge of the ends of the plurality of associated end tubes, and
wherein a body of the at least one end stop comprises two concave opposite edges with their concavity horizontally oriented toward an inside of the at least one end stop.

2. The header tank as claimed in claim 1, wherein the at least one end stop is configured to be positioned facing the internal surface of the end of the one of the plurality of the associated end tubes with a clearance less than or equal to one millimeter.

3. The header tank as claimed in claim 2, configured to accept ends of tubes having at least one flare and wherein the at least one end stop has an overall shape that complements the shape of the at least one flare of the end of the one of the plurality of associated end tubes.

4. The header tank as claimed in claim 3, the header tank being configured to accept ends of flared tubes of polygonal shape, of which at least two sides are connected by a rounded vertex, and wherein the at least one end stop has at least one curved portion of a shape complementing the rounded vertex of the end of the one of the plurality of the associated end tubes.

5. The header tank as claimed in claim 4, wherein the at least one end stop has an oblong overall shape with two curved longitudinal end portions configured to collaborate with two opposing rounded vertices of the end of the one of the plurality of the associated end tubes.

6. The header tank as claimed in claim 5, wherein the at least one end stop has a tapered central portion.

7. The header tank as claimed in claim 1, comprising:
a header plate configured to have the ends of at least one row of tubes of a heat-exchange core bundle passing through it; and
a cover assembled with the header plate in such a way as to close the header tank, the at least one end stop being formed as one piece with the cover, extending in the direction of the header plate.

8. The header tank as claimed in claim 1, wherein a cross section of the at least end stop is configured to be smaller than a cross section of the one of the plurality of the associated end tubes inside the core bundle.

9. The header tank as claimed in claim 1, wherein a cross section for passage of a heat-transfer fluid in a region of the at least end stop is configured to be not smaller than a cross section for passage of the heat-transfer fluid of the one of the plurality of the associated end tubes inside the core bundle.

10. The header tank as claimed in claim 1, wherein the at least one end stop is configured to be at least partially inside the end of the one of the plurality of the associated end tubes.

11. A mechanically assembled heat exchanger for a motor vehicle, comprising:
a mechanically assembled heat-exchange core bundle, the core bundle comprising at least one row of tubes comprising a plurality of associated end tubes one at each end of the at least one row of tubes; and
at least one header tank into which ends of the at least one row of tubes open, the at least one header tank comprising at least one end stop configured to:
be positioned facing an internal surface of the end of one of the plurality of the associated end tubes, and
collaborate with the internal surface in such a way as to prevent the one of the plurality of associated end tubes from moving in a direction of an interior volume of the at least one header tank,
wherein the at least one header tank is configured to accept ends of the plurality of the associated end tubes having two opposite long edges,
wherein the at least one end stop is configured to collaborate with at least one long edge of the ends of the plurality of the associated end tubes, and
wherein a body of the at least one end stop comprises two concave opposite edges with their concavity horizontally oriented toward an inside of the at least one end stop.

12. The heat exchanger as claimed in claim 11, wherein the at least one end stop is arranged at least partially inside the end of the one of the plurality of the associated end tubes.

* * * * *